US005792378A

United States Patent [19]

Christensen et al.

[11] Patent Number: 5,792,378

[45] Date of Patent: Aug. 11, 1998

[54] METHOD AND APPARATUS FOR CONTROLLING THE FLOW RATE AND AIMING WHEN POURING MOLTEN MATERIAL FROM A CONTAINER

[75] Inventors: Stanley E. Christensen; Richard E. Whitman, both of Ukiah, Calif.

[73] Assignee: Lockheed Martin Advanced Environmental Systems, Inc., Ukiah, Calif.

[21] Appl. No.: 691,782

[22] Filed: Aug. 2, 1996

[51] Int. Cl.[6] ..... B22D 37/00

[52] U.S. Cl. ..... 222/590; 222/604; 164/457

[58] Field of Search ..... 164/457, 336, 164/136, 335; 222/590, 591, 594, 604

[56] References Cited

U.S. PATENT DOCUMENTS 2,892,225 6/1959 Burher et al. ..... 164/336
3,856,183 12/1974 Bauer ..... 222/590
4,823,263 4/1989 Thomas et al. ..... 222/604
5,381,855 1/1995 Mezger ..... 164/457

*Primary Examiner*—Scott Kastler
*Attorney, Agent, or Firm*—Townsend and Townsend and Crew

[57] ABSTRACT

A method and apparatus for pouring molten metal in a crucible over a pouring lip of the crucible and into an opening in a mold is disclosed. The crucible and the mold are inside a chamber under vacuum, and the crucible is supported on a holder which is rotatable about first and second, spaced-apart, parallel, horizontal axes. The location of the first axis is selected so that over a limited arc the pouring lip moves primarily horizontally over a preselected distance such as 12–18 inches. The second axis is located so that tilting of the crucible about it causes the molten liquid to flow over the pouring lip. When the molten metal is to be poured, the manually or computer controlled actuators tilt the crucible about the first and second axes to position the lip so that the stream of metal flows into the mold opening at a predetermined rate.

31 Claims, 10 Drawing Sheets

METHOD AND APPARATUS FOR CONTROLLING THE FLOW RATE AND AIMING WHEN POURING MOLTEN MATERIAL FROM A CONTAINER

NOTICE REGARDING COPYRIGHTED MATERIAL

A portion of the disclosure of this patent document contains material which is subject to copyright protection. The copyright owner has no objection to the facsimile reproduction of any of the patent documents or the patent disclosure as it appears in the Patent and Trademark Office file or records, but otherwise reserves all copyright rights whatsoever.

BACKGROUND OF THE INVENTION

The present invention relates to increasing the control over the aiming and the pour rate of liquid streams, especially streams of molten metals and metal alloys.

Metals, particularly specialty alloys, are frequently melted in open containers or crucibles and then poured from the container over its rim, a lip or a specially formed pouring spout into appropriate receptacles or molds. Particularly when pouring into molds, the stream of molten metal must be precisely aimed to prevent metal splashing, possible damage to the mold, and/or waste of often expensive metals or alloys.

The trajectory of the molten metal stream being poured from the crucible onto a target; say, into a mold, is affected by a large number of variables, such as variations in the size and geometry of the crucible, the presence or absence of spouts or shaped pour lips on the crucible, and/or the melt boxes which surround the crucibles, the total pour time and volume, as well as the desired pouring rate, which may be fixed or variable over the duration of the pour as may be required by various mold funnel designs, liquid entry filtering and/or gating requirements.

The location of the mold funnel or hole relative to the crucible in terms of both their vertical and horizontal separations also affects the required relative positioning of the pouring edge, lip, spout, etc. (hereinafter collectively referred to as "lip") to properly aim the stream of metal and control its flow rate.

The relative positioning of the crucible, and in particular of the pouring lip with respect to the pouring target, is further affected by the positioning of the crucible within the crucible surrounding melt box. For example, the amount of clearance of the crucible lip above the box is important because it affects whether or not the molten metal will clear the top edge of the box during pouring and how much cooling effect the pouring lip will have on the metal when it is first poured.

The positioning of the pouring lip is also a function of the extent to which the crucible is filled with molten metal. The dynamic nature of liquids during pouring is subject to hydraulic, inertial and other effects which change the shape and/or direction of the stream of molten metal as the pouring progresses. The trajectory of the stream of liquid poured from a container which is, for example, 50% full can be significantly different from that which results when the container is initially only 25% full.

Finally, the size, shape and trajectory of the pouring metal is affected by the relative position of the tilt axis of the crucible.

In the past, crucibles were tilted about a single axis, the degree of tilting being used to control the rate of flow. Tilting could only marginally affect the directionality and impact point of the stream. Thus, to properly target the stream it was frequently necessary to position and reposition the mold relative to the pouring lip of the crucible and/or to mount the crucible on a movable support to improve the targeting of the stream. Such techniques are difficult or impossible to employ in closed high temperature and/or vacuum environments as are frequently encountered in metal alloying.

Yet, in metallurgical furnaces it is often desirable to pour under a wide variety of process conditions while still delivering the metal precisely on target, e.g. to a precise position on a mold such as its pouring hole or funnel. The problem is compounded because the same furnace might be used to make, for example, 50-lb. pours into equiax molds in as little as 0.5 seconds in one setup and 250-lb. pours into directional solidification molds in as much as 30 seconds in another setup. Conventional, single-axis tilt pour crucibles lack the needed flexibility, could not be easily and quickly set up, and could not assure good repeatability.

SUMMARY OF THE INVENTION

The present invention overcomes the problems encountered with prior art single-axis crucibles by tilting the crucible about two parallel, spaced-apart, horizontal axes. A first or translation axis has a relatively large spacing from the molten metal fill level in the crucible and permits tilting of the crucible over a restricted arc to either one or both sides of a vertical plane aligned with the translation axis. This enables primarily horizontal movements of the pouring lip over significant distances; say, over 6–9 inches to either side of the vertical plane, to change the horizontal position of the pouring lip relative to the target, such as the intake funnel of a mold. A second or pour tilt axis is spaced a lesser distance from the liquid level in the crucible and permits tilting movement of the crucible over a much larger arc of, for example, in the range between 90° and 120°. It causes the needed vertical movement of the pouring lip for lowering it below the liquid level in the crucible to initiate the flow of molten metal.

The present invention includes a method for pouring liquids, and in particular molten metals and alloys ("melts") into an opening of a mold, by filling a crucible to a level not exceeding a level of a pouring lip of the crucible, determining a desired rate at which the molten metal is to be poured into the mold opening, placing the mold generally beneath the pouring lip, and positioning the pouring lip relative to the mold opening so that the molten metal pours into the mold opening at the desired rate. This is accomplished by tilting the crucible about the above-mentioned parallel, spaced-apart translation and pouring axes. The translation axis is positioned for moving the lip primarily in a horizontal direction while the pouring axis is positioned for moving the lip primarily in a vertical direction to initiate pouring the metal over the lip. Tilting the crucible about the two axes is coordinated, preferably with software and a computer, so that the metal pours at the desired rate into the mold opening.

The present invention further provides apparatus for practicing the above-described method, which, in general terms, comprises a container adapted to be filled with the melt and having a pouring lip and a holder mounting the crucible so that the pouring lip can be located generally above the mold opening. The container includes spaced-apart, parallel, horizontal translation and pouring axes which are positioned so that when the container is tilted about them in a controlled manner the pouring lip can be moved over a substantial horizontal distance, without substantially affecting a level of the lip relative to the mold opening, and over a vertical distance, for initiating pouring the melt over the lip, respectively. The lip movements, under software control, place the pouring lip in a position relative to the target at which the melt flows onto the target at a predetermined rate. Control means determines relative arcs over which the container has to be tilted about the two axes to pour the melt onto the target. A drive system operatively coupled with the holder and the control means effects tilting the container about the two axes over the respective arcs.

To increase the accuracy of targeting the molten metal stream, and since the translational tilting of the crucible about the translation axis necessarily involves some change of the vertical position of the pouring lip, the extent to which the translational movement involves a vertical change of the lip is sensed and compensated for by tilting the crucible in the opposite direction about the pour axis a compensating amount. In this manner the translational movement does not adversely affect the targeting of the stream.

To tilt the crucible about the translational axis through a relatively limited arc of, say, 15°–30°, or for a 12-inch total horizontal displacement of the pouring lip, a fluid-activated, e.g. hydraulic, piston actuator or a double-acting piston rotary hydraulic actuator, for example, is preferably used. A rotary drive such as a hydraulic motor tilts the crucible about the pour axis over a relatively much larger arc of, say, 120°. Although the activation of the actuators can be done manually, the many variables make this difficult. Thus, in the preferred embodiment the present invention employs a computer and appropriate software, which uses the output of position transducers together with separately input data, to determine the required stream trajectory and the desired pour rate or rates, and to activate the actuators until they correctly position the pouring lip relative to the intended target so that, over a given pour or pouring cycle, the molten metal stream will hit the target and flow at the predetermined rate, which may be constant or variable over the duration of the pour.

One embodiment of the present invention is particularly adapted for retrofitting existing, single-pour axis furnaces by incorporating the dual-tilt axis system of the present invention on the outside of existing furnace doors.

DESCRIPTION OF THE PREFERRED EMBODIMENTS

Figure 1:
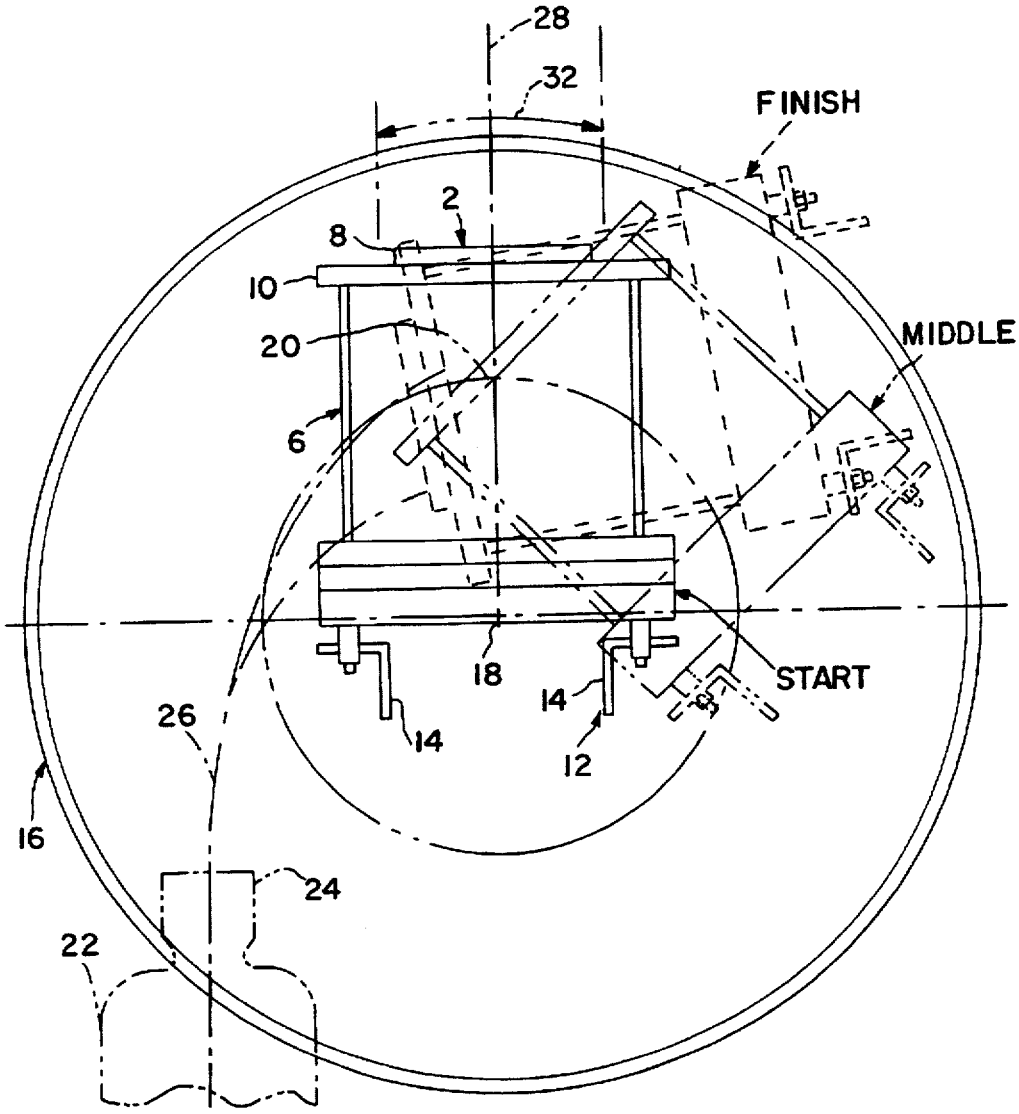
FIG. 1 is a side elevational view which schematically illustrates several positions of a crucible tiltable about dual-tilt axes in accordance with the present invention.
Figure 2:
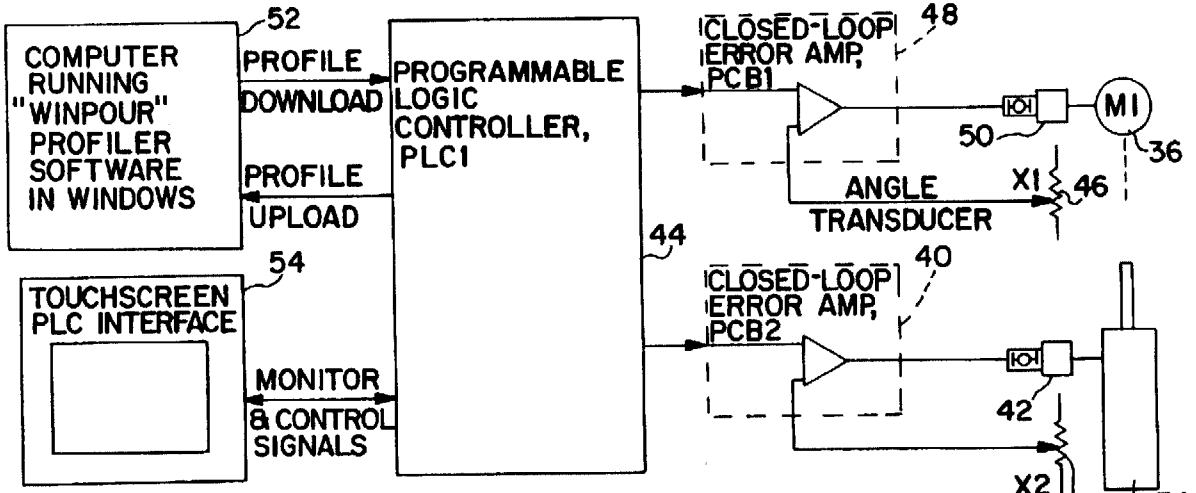
FIG. 2 is a block diagram illustrating the dual-axis tilt control for a first embodiment of the present invention.
Figure 3:
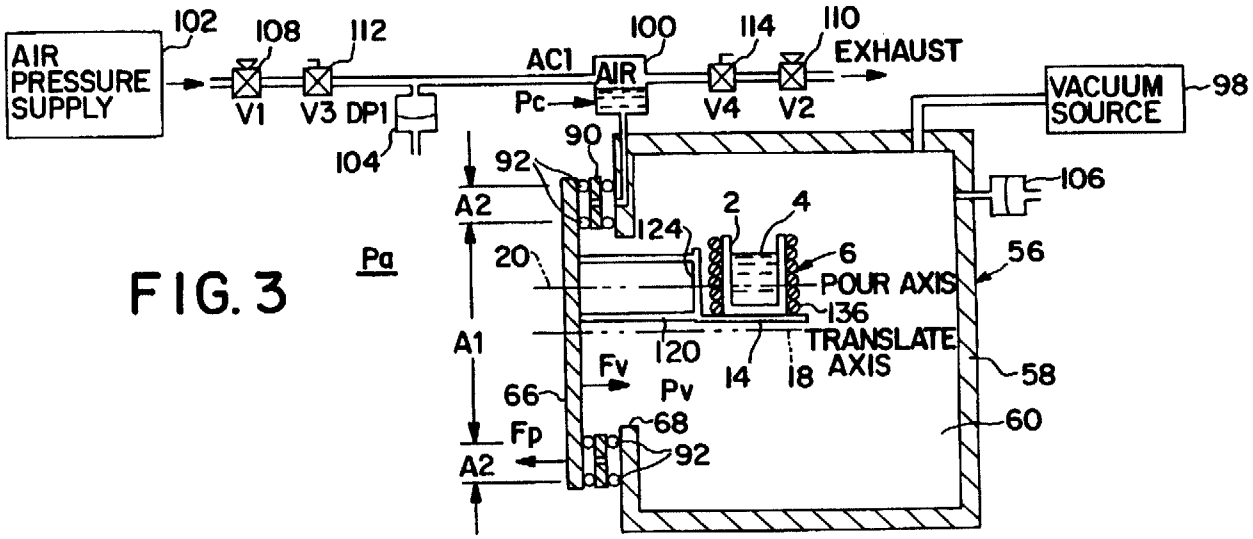
FIG. 3 is a schematic, side elevational view through a melt chamber housing a crucible mounted for dual-axis tilting in accordance with the present invention.

Referring to FIGS. 1 and 3, a crucible 2 filled with molten metal to a fill level 4 is disposed inside a melt box 6 and has an upper edge 8 which projects above a top plate 10 of the box. As is conventional and well known in the art, the melt box includes insulation (not separately shown), induction heating coils 36, and a cavity (not separately shown) which receives the crucible. The melt box is supported on a holder 12 which includes a pair of spaced-apart cantilever arms 14 which in turn are mounted, as discussed in more detail below, on a crucible tilting device 16 for tilting or pivotal movements of the holder, and therewith of box 6 and crucible 2, about a first translation axis 18 and a second, parallel, vertically spaced-apart pour axis 20. The distance between the first translation axis 18 and liquid level 4 is significantly larger than the distance between the pour tilt axis and the liquid level in the crucible.

In use, liquid metal is poured from the crucible onto a target; for example, a mold 22 having an intake opening or funnel 24, by successively moving the melt box, and therewith the crucible, from its upright "Start" position, shown in FIG. 1 in solid lines, past an intermediate "Middle" position, to a fully tilted "Final" position (both shown in phantom lines in FIG. 1) so that the liquid metal flows over a pouring lip (which may be formed by the crucible edge or a spout, not shown) and forms a liquid metal stream 26 with a trajectory leading into mold funnel 24. The trajectory is affected by the multitude of earlier mentioned factors which require a constant repositioning of the pouring lip so that the molten metal stream accurately hits its target, i.e. the mold funnel 24, from the start to the end of the pour.

To move the pouring lip of the trajectory into the proper position, tilting device 16 is activated by pivoting holder 12 about translation axis 18 to move it relative to a vertical plane 28 aligned with the axis in a primarily horizontal direction to either side of the vertical plane as indicated by arrow 32. The crucible is further pivoted about pour axis 20 into successively more inclined positions. This raises and maintains the molten metal level 4 in the crucible above the downwardly tilting pouring lip 8 to begin and maintain the pour and flow metal stream 26 into mold funnel 24.

The relatively large spacing between the translation axis 18 and liquid level 4 assures that tilting about the translation axis over a limited arc leads to the desired primarily horizontal movement of the lip, typically over a total range of between about 9–18 inches and in a presently preferred embodiment about 6 inches to either side of vertical plane 28. The slight vertical displacement of the lip during this tilting movement of the lip is compensated for as discussed below.

The relatively short distance between pour axis 20 and liquid level 4 causes a primarily vertical movement of the pouring lip for first initiating and then maintaining the pour.

Referring now to FIGS. 1–4, a fluid, e.g. hydraulically actuated, translation cylinder 34 pivots holder 12 and crucible 2 about the translation axis 18, and a rotary actuator, such as a hydraulic motor 36, pivots the holder about pour axis 20. The detailed installation of the hydraulic cylinder and motor is described below.

A translation transducer 38 provides horizontal position feedback of holder 12 relative to translation axis 18 and is used to control movement of translation cylinder 34 via a closed loop error amplifier PC board 40 and a servo valve 42. Other input for the closed loop error amplifier for moving the holder about the translation axis is supplied by a programmable logic controller (PLC) 44.

Similarly, an angle transducer 46 provides angular position feedback of the holder relative to pour axis 20 to another closed loop error amplifier 48 which, under the control of PLC 44, activates hydraulic motor 36 via a second servo valve 50 for moving the holder about the pour axis.

Angle transducers 46, 48 are preferably wire-activated transducers, available from the Celestco Company of 7800 Deering Avenue, Canoga Park, Calif. 91304. Each employs a wire 30 connected to a potentiometer (not shown) of the transducer. Wire 30 of pour angle transducer 46 is guided about a pulley 47 which is concentric with, and pivots with the holder about, translation axis 18. In this manner the earlier mentioned slight vertical movements of the pouring lip during pivotal movements of the holder, and therewith of the crucible, about the translation axis are automatically compensated for. Inaccuracies in the trajectory of the molten metal stream 26 which would otherwise occur as a result of such relatively minor vertical motions of the lip are thereby eliminated with a closed loop hardware system. This allows tilting movement of the crucible about the pour axis to remain independent of crucible translation movements about the translation axis.

In a preferred embodiment, the servo valves 42, 50 are under software control using a Microsoft Windows software package developed using Visual Basic. The software is used to develop two separate profiles that serve as reference signals to simultaneously control the pour angle of the crucible; that is, its tilt angle about pour axis 20, and the horizontal position of the crucible; that is, its tilt angle about translation axis 18. These profiles are downloaded to PLC 44 prior to pouring. At pour time, the PLC supplies the two profile signals via D/A converters (not separately shown) to error amplifier/driver PC boards 40, 48. In the preferred embodiment, a computer 52 runs the profiler software in Windows and includes a touch-screen PLC interface 54.

In the presently preferred embodiment, applicants' "WINPOUR" software includes two major sections: an arbitrary waveform multipoint graphics-based editor and an automatic constant volume editor based on user input geometry and time parameters. The following is a brief description thereof.

Graphics Editor:

The graphics editor contains a menu allowing the user to select various options to create, modify, store, recall, up and download to PLC 44 and display details about pour profiles. Files for the system are systematically maintained in sub-directories of the main program which reside in a directory "WINPOUR". Source files for angle profiles can be kept in a sub-directory "WINPOUR\ANG" and include the extent ".SRC". These source files are compiled into PLC-usable real-time data and can be saved in the same sub-directory with the extent ".RUN". Linear Translation profiles are stored in a sub-directory "WINPOUR\LIN" with the same extent naming convention as angular files. The graphics editor has the following features:

1) Curve fitting.

During profile construction the user has the option of making each profile segment a straight line (constant angular or linear velocity), or a cubic-spline-fit algorithm can be used to automatically generate curve smoothing for the segments. A menu key is used to toggle the function on and off.

2) Data viewing modes.

A preview capability allows the user to view profile appearance prior to compiling. This feature also allows the user to view and edit the profile's numerical data in spreadsheet fashion.

3) Overlay capability.

The graphics editor allows a file to be overlaid along with the profile being viewed or constructed. This allows detailed comparisons of previous results to be used as the basis for profile improvements and modifications. It also allows the simultaneous viewing of both angular and translation profiles so that axis motions can be compared for relative timing.

4) Time-scaling.

Several options can be selected for time scales to facilitate development and optimum viewing of profile data. This feature can also be used to compress/expand profiles to create different pour profile times from existing profiles.

5) Compiler interval options.

The user can select either 25 or 50 mS as the spacing interval between profile points. The shorter interval is desirable for fast, short profiles where resolution is important. The longer interval can be required when very long, slow profiles are made in order to restrict data files to reasonable lengths in the PLC. (Maximum PLC profile length is 1000 points for each axis.)

6) PLC upload/download access.

Overlay files displayed on the graphic editor can be sent directly to the target PLC processor, subject to safety interlock conditions which prevent the user from downloading profiles under inappropriate circumstances. Software in the PLC ladder in conjunction with manual controls allows the PLC to "capture" a pour which the graphics editor can subsequently upload to hard disk.

Constant Volume Editor:

This editor is used to automatically generate both angle and translation profiles that can either be used directly by the target PLC or subsequently refined in the graphics editor. To create a new profile, the user enters information regarding crucible 2, melt box 6 and mold geometry involved as well as the desired time of pour and final pour angle desired. As with the graphics editor, source and run files can be saved using disk and file-specifier boxes. Source files are stored under the sub-directory "WINPOUR\VOL". PLC run-files are stored under the "WINPOUR\ANG" and "WINPOUR\LIN" sub-directories as before.

Features:

1) Custom units allow the user to specify parameters in different units, e.g. in metric or English units.

2) A computational convenience is included to display relationships between alloy densities, crucible capacities, charge volumes and wash-lip angles.

3) User-selectable compile time-base 25/50 mS option.

Figure 8:
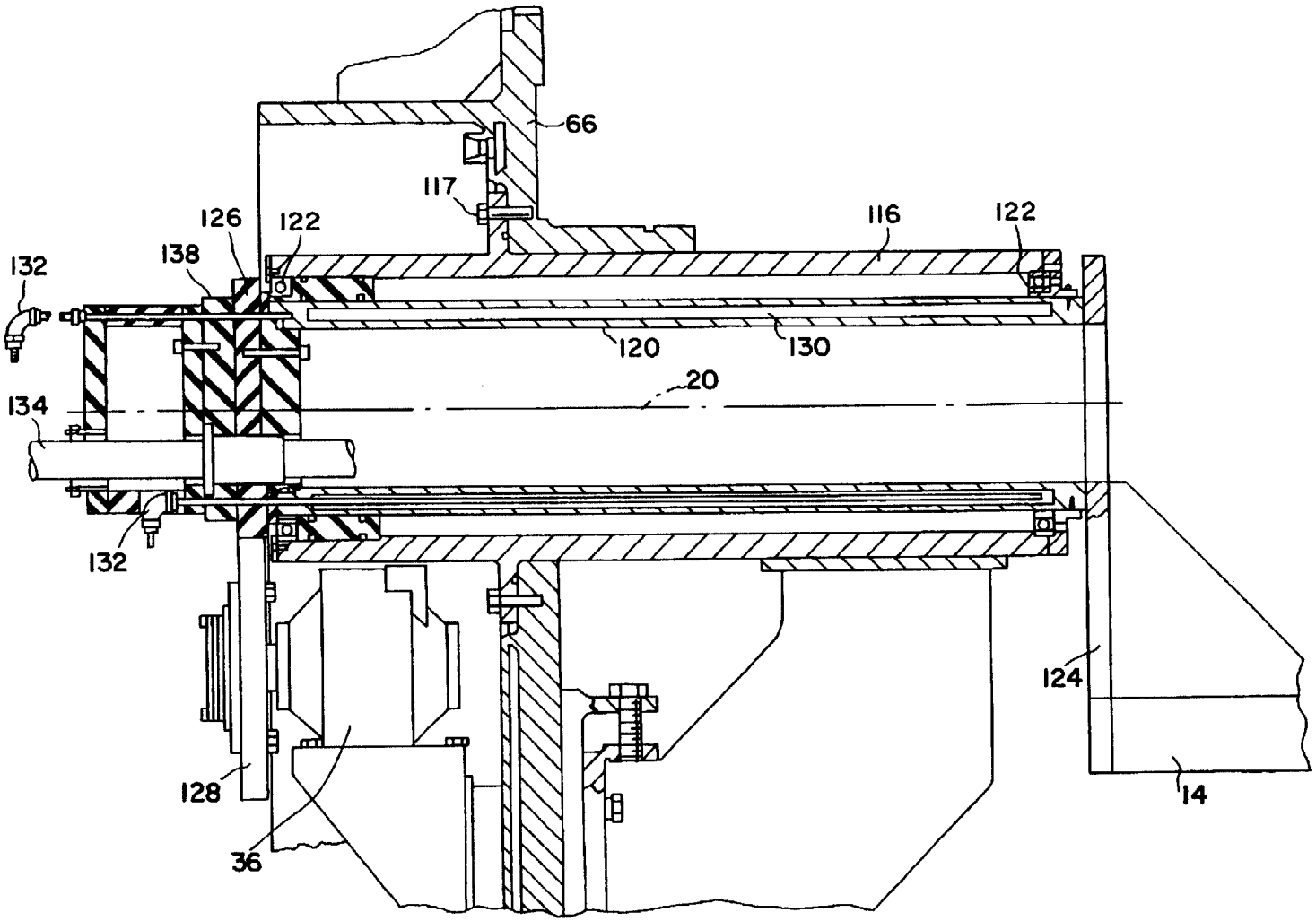
FIG. 8 illustrates a user interface screen used to monitor and control the dual-axis pour system of the present invention with software described herein.

The WINPOUR profile package described above works in conjunction with ladder software created for Allen-Bradley PLC 5 series processors (although it can be adapted for use on other processors as well). FIG. 8 illustrates the user-interface screen used to monitor and control the WINPOUR dual-axis pour system. Touch-screen keys are used to select specific angles and translation positions useful for loading, melting, temperature measurement, automatically tilting the crucible to perform a wash-lip, etc. The screen also allows real-time viewing of profile data and interlocks related to pour control. A button is available to trigger synchronized dual-axis pours, or an individual axis may be triggered while the opposite axis is manually controlled using a "joystick" pot (not separately shown) located at a furnace viewport (not shown). When the furnace is operated in automatic mode, pour profile names are included in computer-based recipes for all the desired profiles to be downloaded with other furnace control parameters. Normally one profile for each pour axis can be resident in the PLC at any given time and its name is displayed on the touch-screen. Each axis can be recorded in the PLC during manual operation. It is also possible to record transducer signals resulting from automatic pours. Such information can be uploaded to confirm that the furnace hardware is reliably performing the desired motion control.

Storing operating profiles in the PLC has the following advantages:

1) Performing pours from the PLC environment is a fast, effective way of interfacing to furnace hardware for real-time control and associated interlocking.

2) While the Windows environment is an excellent area for developing complex profiles, especially with the availability of other convenient tools for storage, analysis and documentation, high system reliability is achieved during operation by letting the PLC perform the pour. The system then does not have to rely on the computer for high-speed multi-tasking and is not subject to computer failures. The computer is thus left free to perform more conventional tasks like data-acquisition or be used as a generic tool—freed from furnace activities.

3) It is possible to re-use the same PLC-resident profiles without the need for a computer, once a profile has been downloaded. In systems where wide-pour parameter variation is not required, it is possible to create some basic profiles using the WINPOUR editors and keep them on file in the PLC as a "mini-library" for a minimum cost system.

In spite of the fact that a PLC can be used effectively to perform pouring in concert with the furnace hardware described, the WINPOUR profile development software is excellent for developing the actual motion control desired. On occasion it may be efficient to use the WINPOUR software as a stand-alone tool separate from the target furnace to develop profiles which can then be sent to the operating furnace. This can be effectively done, for example, using water and steel shot as fairly accurate substitutes for molten metal. Because production time on metallurgical furnaces can be quite expensive, this approach can justify, under appropriate circumstances, the cost of a development unit.

Figure 4:
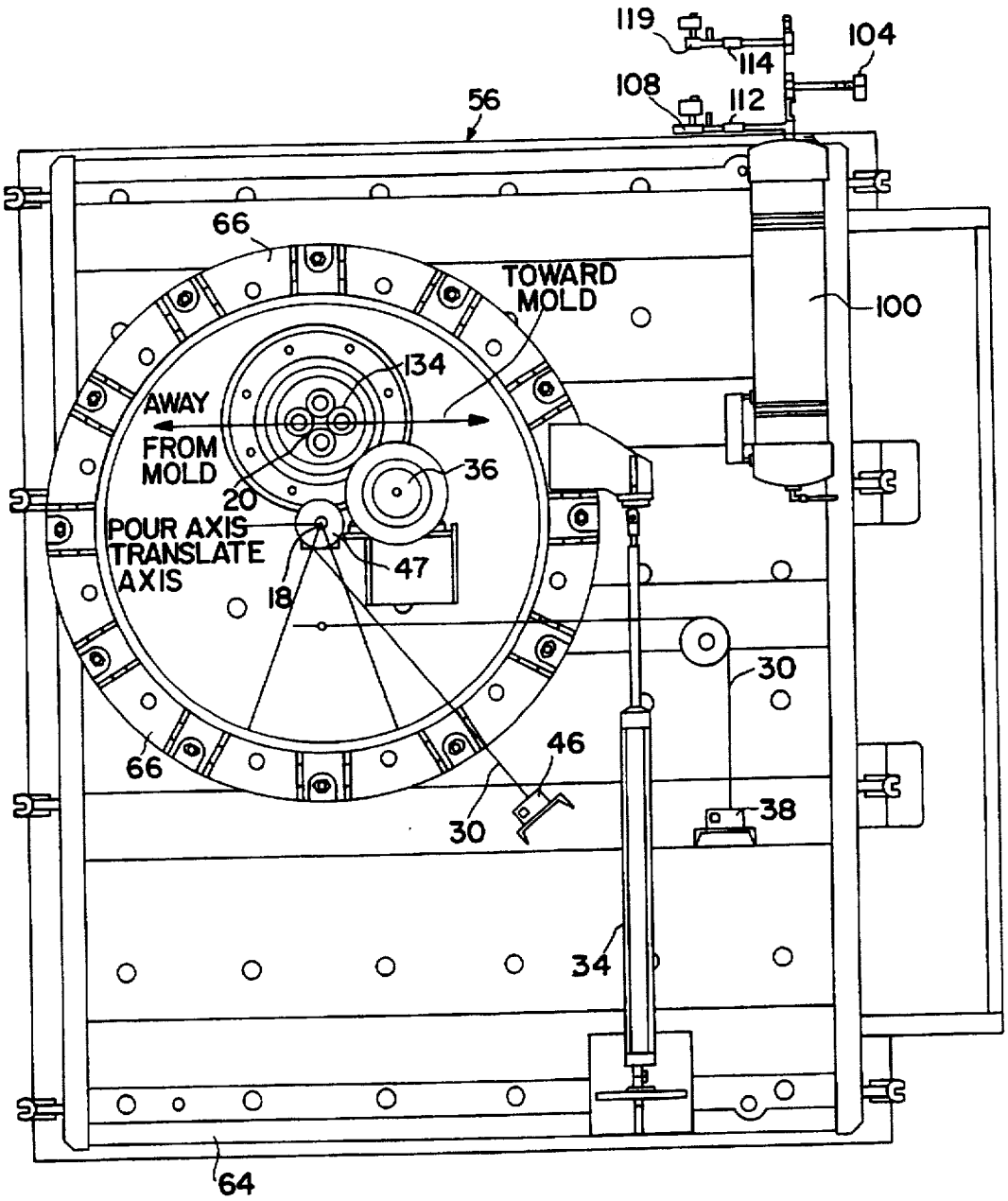
FIG. 4 is a detailed, front elevational view of the melt chamber and illustrates the dual-axis tilting mechanism of the present invention in greater detail.

Turning now to a detailed description of the furnace hardware and referring to FIGS. 3 and 4, a furnace 56 has a melt chamber 60 which holds crucible 2 and melt box 6 inside a housing 58. A forward end of the housing is closed with a door 64 (not shown in FIG. 3) which includes, towards its upper left-hand corner (as seen in FIG. 4), a cutout 68. A circular translation plate 66 is part of crucible holder 12 and covers the cutout.

Referring now to FIGS. 2–6, an alignment ring 70 concentric with cutout 68 in furnace door 64 is attached to a door flange 72 with bolts 62. It has an outer, circular periphery 74 which serves as a path for 12 roller bearings 76 bolted to translation plate 66 so that the latter can pivot concentrically about translation axis 18.

The translation plate includes a tubular flange 78 which extends towards the inside of the furnace, is spaced radially inwardly cutout 68 in the door, and includes a locking ring 80 which prevents inward movement (towards the interior of the furnace) of a clamping ring 82. The latter has a plurality of, e.g. 12, equally spaced circular recesses 88 which receive pressure pads 86 made of a material, such as brass, which generates relatively low friction when it engages the inwardly facing surface of alignment ring 70. Bolts 84 are tightened to press the pads against the alignment ring. Locking rings 80 prevent axial movements of the clamping ring when the bolts are tightened and thereby mount the translation plate on the door.

A floating gasket ring 90 is disposed in an annular recess between opposing faces of alignment ring 70 and translation plate 66. It is preferably also made of a low-friction (with respect to steel) material such as brass or bronze. The gasket ring includes a pair of spaced-apart O-rings 92 on each side to prevent leakage past the gasket ring and thereby seal the interior of the furnace from the exterior.

Each side of the gasket ring includes an annular recess between the pairs of O-rings 92 which are interconnected by a bleed hole 94 and together form a pressure space 93. There is further a pressure fluid passage 96 in alignment ring 70 for connecting the space 93 to a source of pressurized fluid.

Thus, translation plate 66 is centered with respect to the translation axis 18, is pivotable about periphery 74 of alignment ring 70, and is secured to the latter by tightening pressure pads 86 with bolts 84. To permit pivotal motions of the translation plate, it is best to first tighten bolts 84 and then back them off slightly to establish light play, or a small clearance, between the stacked pressure pads 86, alignment ring 70 and gasket ring 90. Play between these parts is limited so that O-rings 92 continue to be compressed and form a seal.

In use, a vacuum source 98 evacuates melt chamber 60, which urges the translation plate with a force $F_v$ inwardly as is illustrated in FIG. 3. Without compensating therefor, this force fully compresses O-rings 92 and acts against gasket ring 90. To prevent a full compression of the O-rings and undesirable high friction between the gasket plate, the alignment ring and the translation plate, compensating oil pressure from an oil accumulator 100 is applied to space 93 between the pairs of O-rings 92 via pressure passage 96.

When the furnace is evacuated, the area $A_1$ of translation plate 66 radially inward of the inner O-ring 92 is subjected to a pressure differential $P_v-P_a$ ($P_v$ being the pressure inside the evacuated furnace, and $P_a$ being atmospheric pressure). This pressure differential forces the translation plate against the gasket ring and the furnace door.

The annular area $A_2$ between the inner and outer O-rings 92 is filled with an oil suitable for high vacuum use (during filling, air being bled through vent 101 which is otherwise closed by plug 103). The oil also serves as a lubricant and is subjected to pressure $P_c$ from oil accumulator 100 which is driven by air from air source 102 and is used to moderate the rate of pressure change in the oil. This produces a compensating force $F_p$ on the translation plate which counteracts the force $F_v$ caused by the vacuum, thereby preventing excessive friction and a full compression of the O-rings. The required compensating pressure is directly related to the ratios of the two areas involved, namely:

$$(P_a-P_c)=(P_v-P_a)\times(A_1/A_2)$$

The PLC 44 (shown in FIG. 2) uses this relationship to compute and dynamically control the compensation pressure. Differential pressure gauges 104 and 106 serve as pressure sensors for the system. The pressure responsive signal from pressure gauge 106 is multiplied by $A_1/A_2$ to determine the required compensation pressure $P_a-P_c$. This is compared with the actual difference measured by pressure gauge 104 to create a control signal to either raise the pressure in the oil accumulator 100 by permitting more air through valve 108 or reduce the air pressure in the accumulator by opening relief valve 110. The oil pressure in the annular space between the inner and outer O-rings increases and decreases correspondingly so that variations in either the furnace vacuum and/or the atmospheric pressure are dynamically compensated for. Regulator valves 112, 114 are preferably provided for controlling the rates of air flow into and out of the air accumulator.

Referring now to FIGS. 3–5 and 9, a port tube 116 is secured to translation plate 66 with bolts 117 and extends in alignment with pour axis 20 from the exterior of the translation plate into melt chamber 60. A tubular shaft 120 is rotatably mounted inside the port tube with roller bearings 122. On its end inside the melt chamber, the shaft mounts a support bracket 124 from which the earlier discussed cantilever arms 14 extend further into the melt chamber. As is best seen in FIG. 3, melt box 6 and crucible 2 are carried on the cantilever arms.

The opposite end of the tubular shaft mounts a spur gear 126 which meshes with a sprocket 128 driven by hydraulic motor 36 to pivot the shaft, and therewith the melt box and the crucible, about pour axis 20.

Shaft 120 includes an axially oriented cooling chamber 130 which, for example, is water cooled via pipe fittings 132. In addition, electrical cables 134 for the induction coils 136 extend from the exterior of the translation plate, past suitable insulation disks 138, and through the hollow interior of tubular shaft 120 to induction coils 136 of melt box 6.

Figure 7:
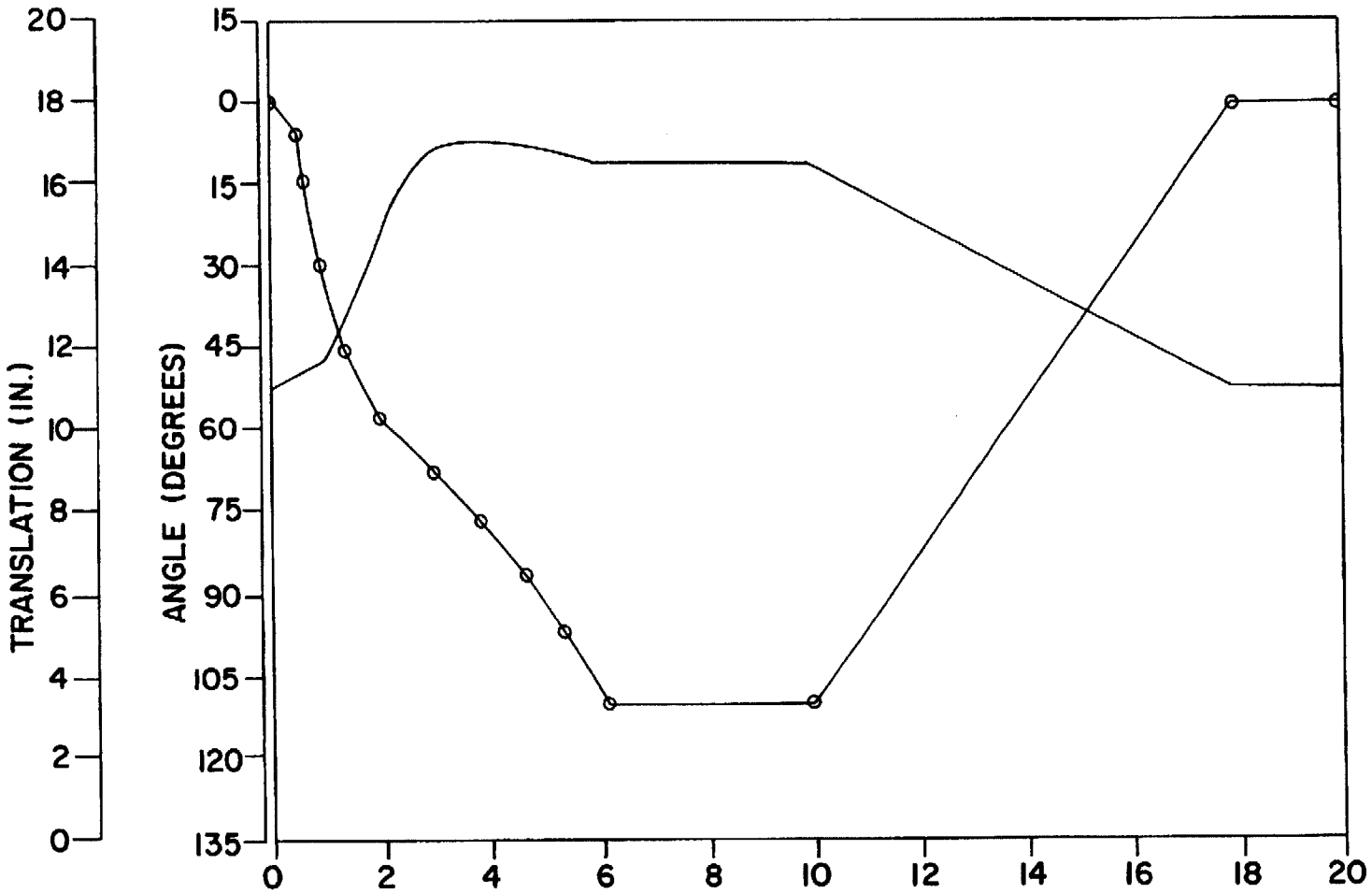
FIG. 7 is a diagram showing the motion of the pouring lip about the dual-tilt axis from the beginning to the end of a pouring cycle.

Referring to FIGS. 1–4, when metal is to be poured into mold 22, crucible 2 is initially in its upright position as shown in solid lines in FIG. 1. The requisite trajectory data is generated by the WINPOUR software and, based on data concerning the fill level 4 in the crucible, the relative location of mold funnel 24, the metal or alloy in the crucible, the desired pour rate or rates and duration, etc., determine the motion profile for the pouring lip; for example, in correspondence with the diagram of FIG. 7. The PLC correspondingly controls and operates servo valves 42, 50 to extend or contract piston rod 140 of hydraulic actuator 34, and thereby pivot translation plate 66 via a bracket 142 to position the pouring lip horizontally relative to the mold funnel, and, when pouring is to be initiated, by the simultaneous operation of hydraulic motor 36 to pivot tubular shaft 120 about pour axis 20 and tilt the crucible; say, into the "Middle" position illustrated in phantom lines in FIG. 1. This lowers the pouring lip relative to the liquid level in the crucible until the latter exceeds the former and pouring commences. Operation of the hydraulic cylinder and motor continues; say, to gradually tilt the crucible into the "Finish" position, also shown in phantom lines in FIG. 1, by executing the appropriate pivotal movements of crucible holder 12 about the translation and pour axes so that a molten metal stream trajectory is maintained which accurately ends in mold funnel 22. Of course, both before and during pouring, the vacuum is maintained in melt chamber 60, and oil accumulator 100 generates the needed compensating pressure $P_c$ to balance forces $F_v$ and $F_p$ in the earlier described manner.

A second embodiment of the present invention is particularly useful for converting single-axis pouring systems on existing furnaces to the dual-axis pouring system of the present invention by retrofitting.

Figure 10:
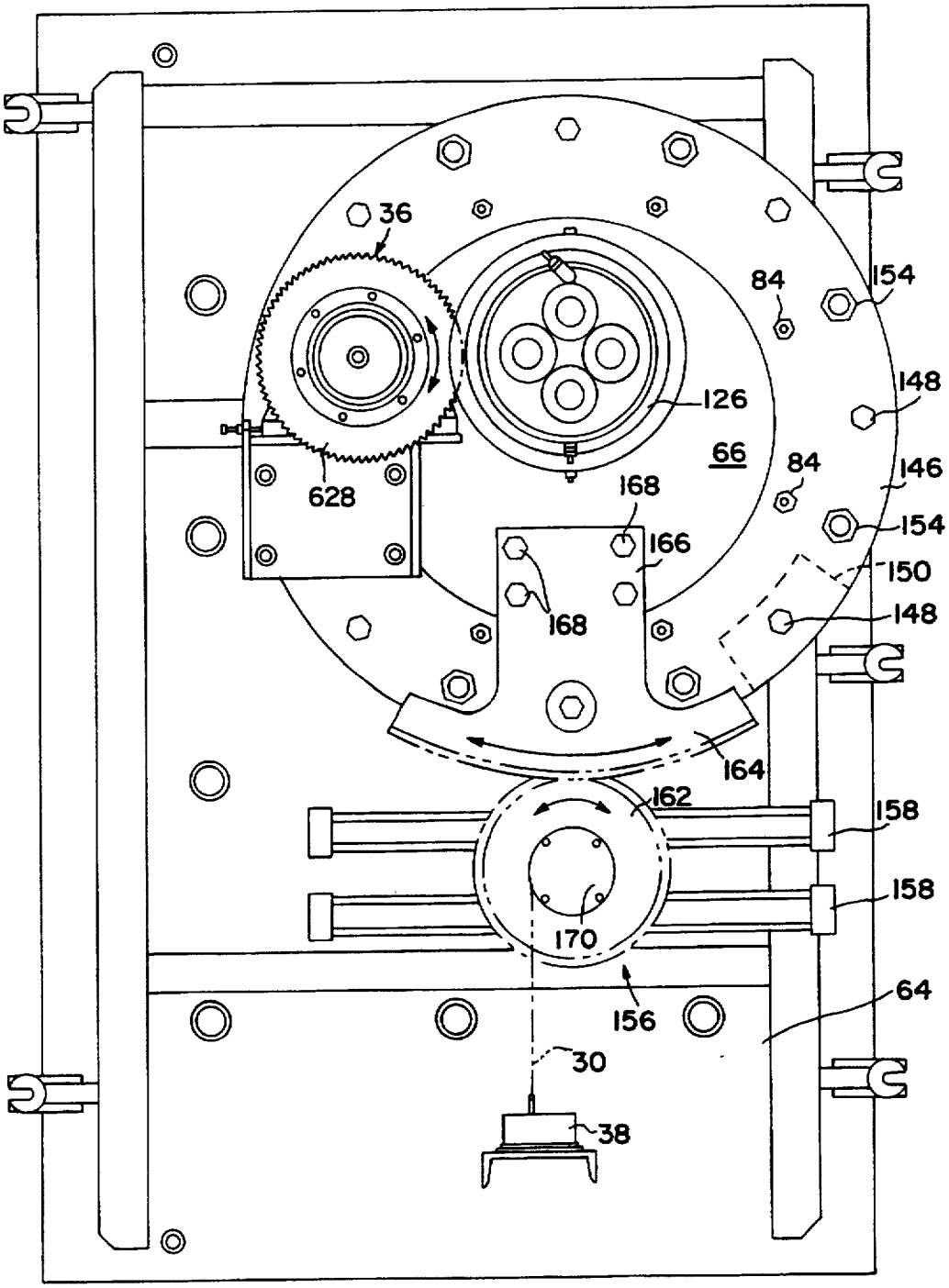
FIG. 10 is a block diagram illustrating the dual-axis tilt control for a second embodiment of the present invention.
Figure 11:
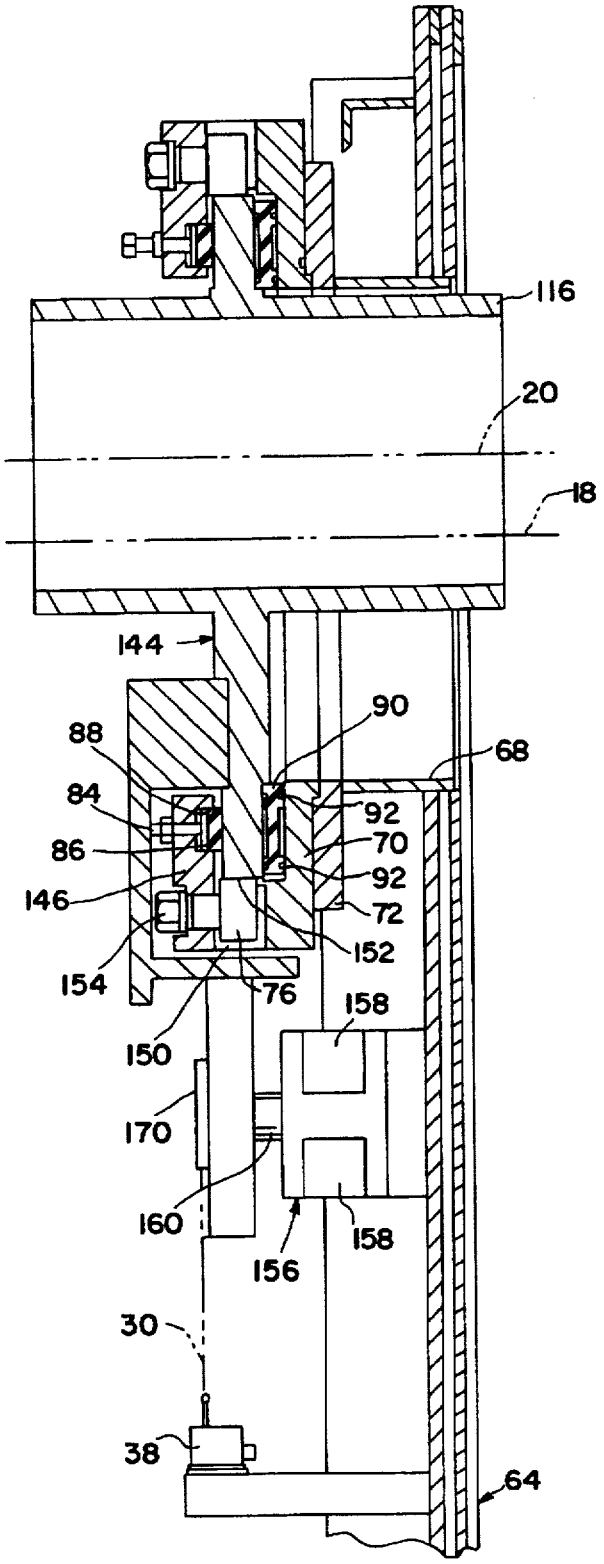
FIG. 11 is a detailed, front elevational view of a melt chamber similar to FIG. 4 and illustrates the dual-axis tilting mechanism of the second embodiment of the present invention.

Referring now to FIGS. 10–11, as in the first embodiment of the present invention described in conjunction with FIGS. 3 and 4, the furnace has a melt chamber which holds a crucible and a melt box inside a housing (not separately illustrated in FIGS. 10–11). The forward end of the housing is closed with a door 64 which includes; for example, at its upper right-hand corner (as seen in FIG. 11), a circular cutout 68. A circular translation plate 144 constructed in accordance with the second embodiment of the present invention is part of the crucible holder (not separately illustrated in FIGS. 10–11) and covers the cutout.

Figure 5:
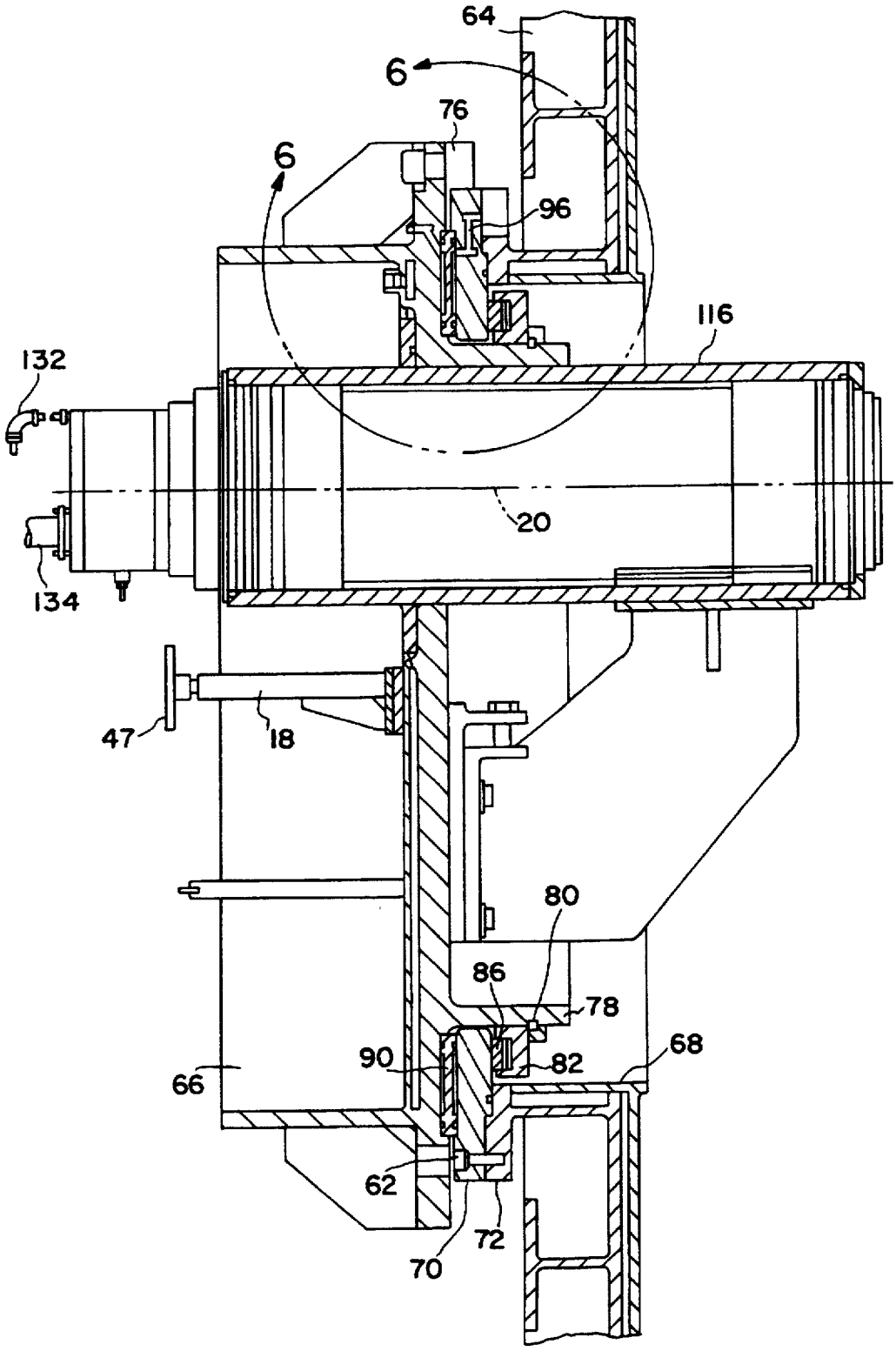
FIG. 5 is a fragmentary, enlarged, side elevational view, in section, which includes further details of the mounting of the crucible for dual-axis tilting.
Figure 6:
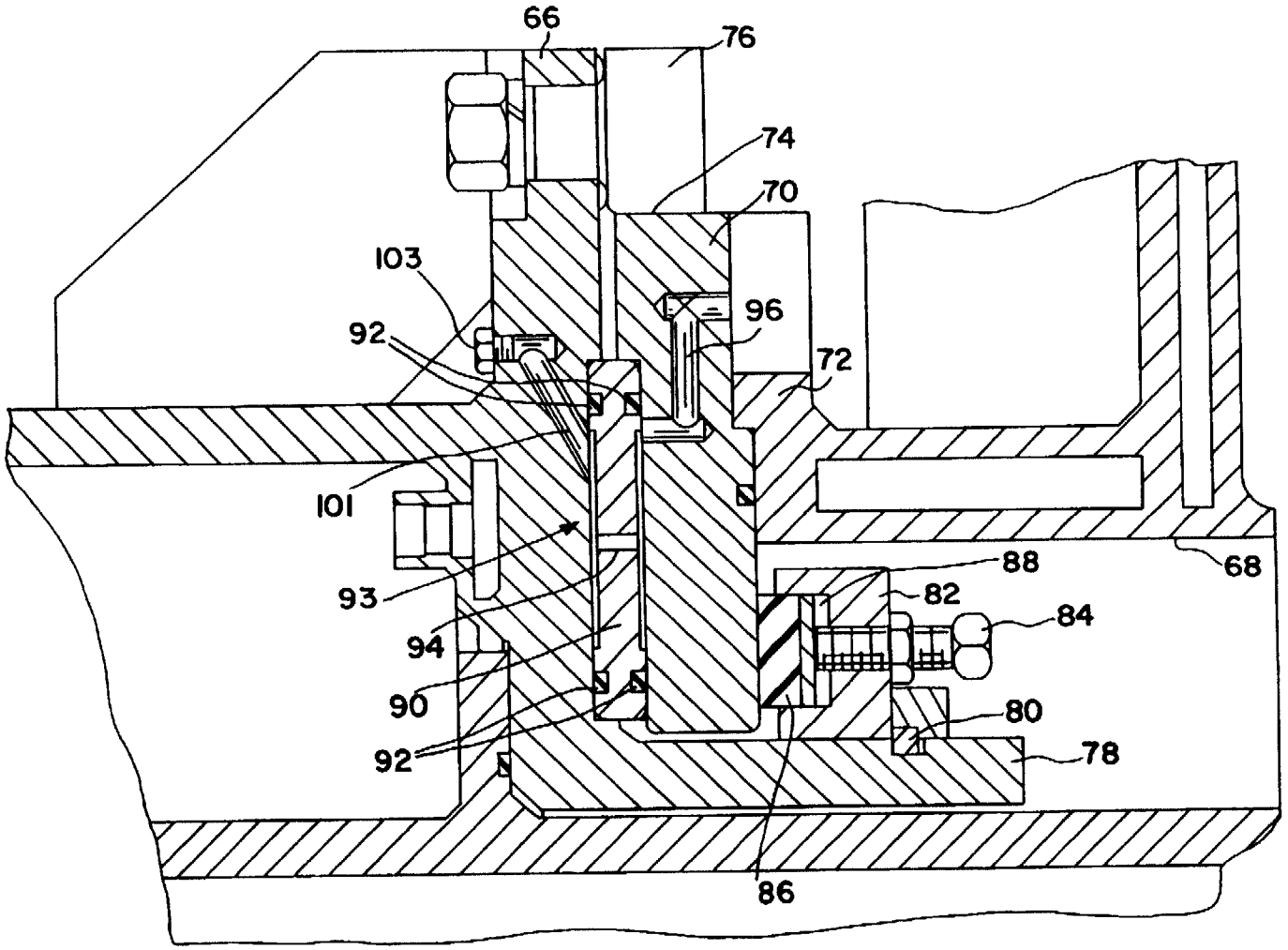
FIG. 6 is a fragmentary, detailed, side elevational view, in section, of Detail 6 of FIG. 5.

As in the first embodiment, alignment ring 70 is concentric with cutout 68 in the furnace door and is attached to door flange 72 with bolts in a manner similar to that shown in FIGS. 4 and 5 and described above. A mounting ring 146 is secured to the side of alignment ring 70 facing away from door 64 with a plurality, e.g. 8, of threaded bolts 148. Spacer blocks 150 provide a spacing between the opposing sides of alignment ring 70 and mounting ring 146.

Pressure pads 86, made of a low-friction material such as brass as previously described, are received in corresponding recesses 88 in the mounting ring, and bolts 84 are tightened, as above described, to press the translation plate against floating gasket ring 90 disposed between opposing sides of alignment ring 70 and translation plate 66 and fitted with pairs of spaced-apart O-rings 92.

Thus, translation plate 66 can pivot about translation axis 18 in the above-described manner. Pressure pads 86 maintain the plate in firm contact with the alignment ring and seal the annular spaces between the sets of O-rings 92 for equalizing pressure as above discussed. However, since the roller bearings 76 and pressure pads 86 are accessible from the exterior of the furnace door 64, this arrangement requires relatively less space than that illustrated in FIGS. 4 and 5.

Figure 9:
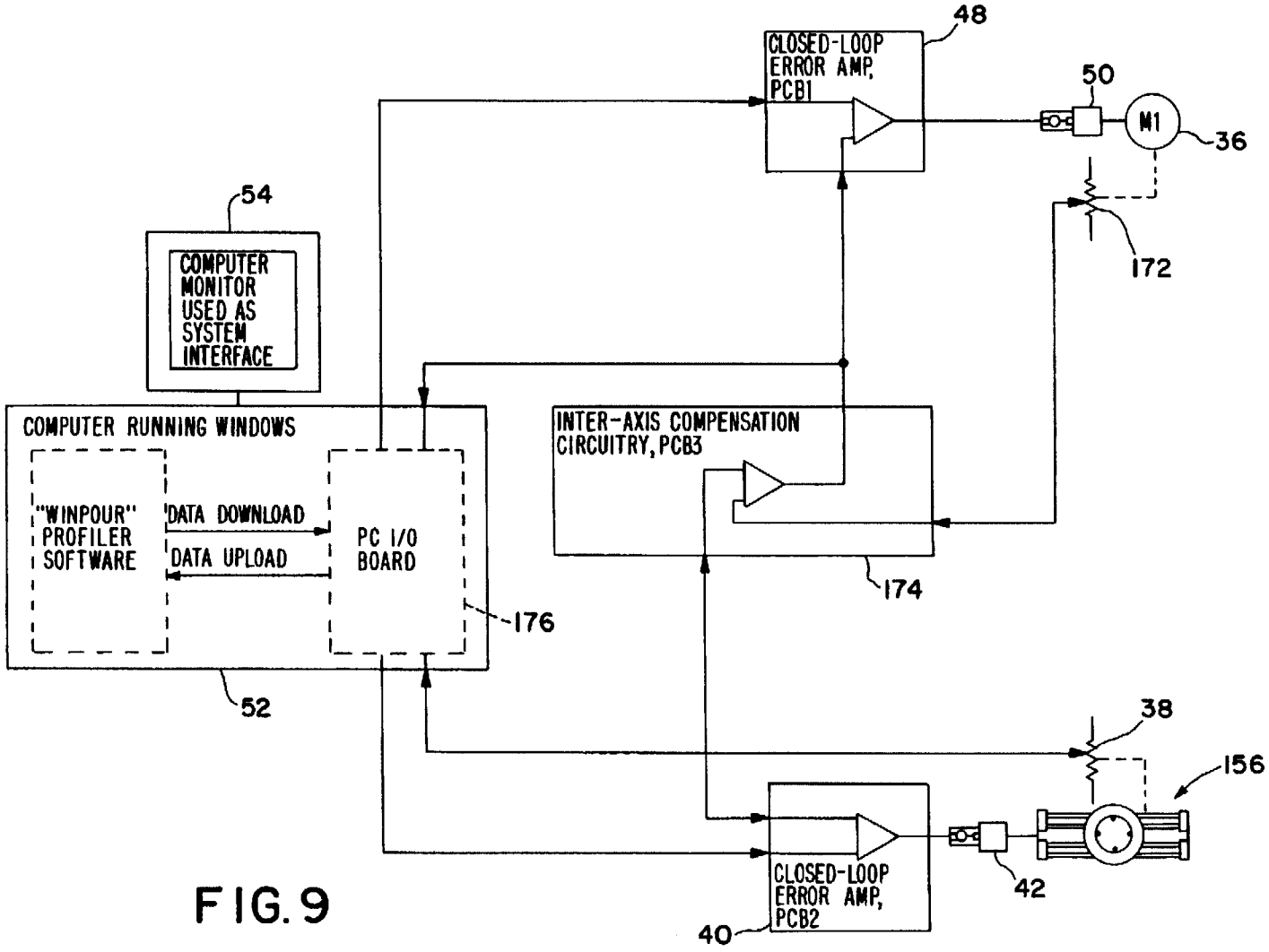
FIG. 9 is a fragmentary enlarged detail of a portion of a holder for the crucible.

A hydraulic motor 36, constructed as earlier described, is mounted to the exterior of translation plate 66 and has a sprocket 128 which drives a spur gear 126 for tilting a shaft (not shown in FIG. 11) such as shaft 120 (shown in FIG. 9) rotatably mounted inside a port tube 116 which forms part of the translation plate and is concentric about the pour axis 20 in the manner shown in FIG. 9 and described above.

Tilting movements of the translation plate about tilt axis 18 are generated by a double-acting hydraulic rotary actuator 156 which is mounted on the exterior of furnace door 64. The hydraulic rotary actuator is preferably of the type available from Parker Fluid Power, Rotary Actuator Division, of Wadsworth, Ohio 44281. Briefly, such an actuator has two, spaced-apart hydraulic piston-cylinder assemblies 158 which rotate a shaft 160 via a rack and pinion drive (not illustrated in the drawings). A gear 162 is keyed onto shaft 160 and meshes with a spur gear segment 164 which includes an arm 166 secured to the outside of translation plate 66 with bolts 168.

Upon activation of the hydraulic actuator 156, gear 162 rotates in one or the other direction to correspondingly tilt the translation plate 66, and therewith the crucible (not shown in FIG. 11), in the above-described manner to position the crucible in an essentially horizontal direction relative to the mold (not shown in FIG. 11) for properly positioning the lip of the crucible relative to the mold so that, thereafter, pouring can be initiated by tilting the crucible with hydraulic motor 36.

The embodiment of the invention illustrated in FIG. 11 includes a translation transducer 38 to provide horizontal position feedback relative to translation axis 18, which in turn is used to control operation of hydraulic actuator 156. A wire 30 has one end attached to the potentiometer (not shown) of the transducer and another end secured to a disk 170 bolted onto and rotating with gear 162.

The embodiment of the present invention illustrated in FIG. 11 is particularly useful for retrofitting existing furnaces, including relatively smaller furnaces with cramped space, so that, for example, as shown in FIG. 11, translation axis 18 is located inside port tube 116. In such situations, an angle transducer for providing annular position feedback of the crucible holder relative to pour axis 20 cannot be employed because there is no space for mounting a pulley (such as pulley 47 shown in FIG. 4) concentric with the translation axis 18. Electronic circuitry is substituted to compensate rotational movements about pour axis 20 for the limited vertical motion of the translation plate when it is pivoted about translation axis 18.

Such a compensating system is illustrated in FIG. 10. It employs an appropriately placed angle transducer 172, including inter-axis compensation circuitry 174 and an I/O board in computer 52, for generating all control signals while eliminating the need for a programmable logic controller (such as PLC 44 shown in FIG. 2). Computer software replaces the PLC programs, which requires that the computer be on-line during pouring to control the operation of hydraulic motor 36 for tilting the crucible about pour axis 20 and hydraulic actuator 156 for tilting the crucible about translation axis 18.

The embodiment of the invention illustrated in FIG. 11 lends itself particularly well for converting existing, single-axis crucible pour systems into the dual-axis pour system of the present invention. All that is necessary is to remove the existing system, cut opening 68 into furnace door 64, and attach the door flange 70 to it. Thereafter the remainder of the tilt system shown in FIG. 11 can be assembled from the exterior of the door to complete the conversion of the furnace to a dual-axis pouring system.

What is claimed is:

1. A method for pouring a melt in a container over a pouring lip of the container onto a target located generally beneath the lip, the method comprising the steps of filling the container with melt to a given level no higher than the lip; determining a desired rate at which the melt is to be poured onto the target; forming first and second spaced-apart tilt axes for the container which are differently spaced from the level; and tilting the container about the first and second axes to thereby move the lip relative to the target so that the melt flows over the lip onto the target at the desired pouring rate.

2. A method according to claim 1 including the step of repositioning the lip while the melt pours onto the target to maintain the desired pour rate as the quantity of melt in the container changes during the pour.

3. A method according to claim 1 including the step of changing the desired pour rate during pouring by repositioning the lip relative to the target during pouring to vary the pour rate accordingly.

4. A method according to claim 1 wherein the step of tilting comprises tilting the container about the second axis to initiate a melt flow over the lip.

5. A method according to claim 4 wherein the step of tilting includes tilting the container about the first axis for moving the lip relative to the target in a primarily horizontal direction.

6. A method according to claim 5 wherein the first and second axes are parallel.

7. A method according to claim 6 wherein the first and second axes are vertically aligned.

8. A method according to claim 5 including the step of continuously sensing a position of the lip relative to the first and second axes, generating position-responsive signals, and using the signals to maintain the desired pouring rate.

9. A method according to claim 5 wherein the step of tilting the container about the first axis comprises translating the lip over a horizontal distance of up to about 12 inches.

10. A method according to claim 9 wherein the step of translating the lip comprises rotationally moving the lip over an arc of no more than about 30°.

11. A method according to claim 9 wherein a location of the first axis is selected so that the level of the melt in the container changes no more than about 2 inches when the lip moves over the horizontal distance of at least about 12 inches.

12. A method according to claim 1 including the step of compensating for a change in a vertical position of the lip as a result of tilting motion of the container about the first axis by tilting the container a compensating amount about the second axis.

13. A method for pouring molten metal into an opening of a mold, the molten metal filling a crucible to a level not exceeding a level of a pouring lip of the crucible, the method comprising the steps of determining a desired rate at which the molten metal is to be poured into the mold opening; placing the mold generally beneath the pouring lip; and positioning the pouring lip relative to the mold opening so that the molten metal pours into the mold opening at the desired rate by tilting the crucible about first and second, parallel, spaced-apart axes, the first axis being positioned for moving the lip primarily in a horizontal direction, the second axis being positioned to move the lip primarily in a vertical direction to effect pouring the metal over the lip, and coordinating the tilting steps about the first and second axes so that the metal pours at the desired rate into the mold opening.

14. A method according to claim 13 including the step of repositioning the crucible while molten metal pours over the lip into the mold opening as a function of at least one of a change in the amount of molten metal in the crucible, the level of the lip relative to the mold opening, the horizontal position of the lip relative to the mold opening, and the orientation of the lip to maintain the desired pouring rate until sufficient molten metal has been poured into the mold.

15. A method according to claim 13 including the step of creating a vacuum about the crucible, the molten metal, the pouring lip, and the mold opening during at least the steps of tilting the crucible about the first and second axes.

16. Apparatus for pouring a melt onto a target comprising a container adapted to be filled with the melt and having a pouring lip proximate an upper end of the container; and a holder mounting the container so that the pouring lip can be located generally above the target and permitting tilting movements of the container about first and second, spaced-apart, parallel, substantially horizontal axes positioned so that the pouring lip can be moved over a substantial horizontal distance without substantially affecting a level of the lip relative to the target and over a vertical distance for initiating pouring the melt over the pouring lip, respectively.

17. Apparatus according to claim 16 including control means for determining relative tilting arcs over which the container has to be tilted about the first and second axes to pour the melt onto the target at a desired rate; and means operatively coupled with the holder and the control means to effect tilting the container about the first and second axes over the respective tilting arcs for pouring the melt at the desired rate onto the target.

18. Apparatus according to claim 16 including a chamber surrounding the container and the target, and means for applying a vacuum to the chamber.

19. Apparatus according to claim 16 wherein the container comprises a heatable crucible.

20. Apparatus according to claim 16 wherein the target comprises a mold having a hole into which the melt is to be poured.

21. Apparatus according to claim 16 including a housing surrounding the target and the container, and wherein the holder comprises a first member rotatably attached to the housing for rotation about the first axis, a second member rotatably attached to the first member for rotation about the second axis, and means for mounting the container on the second member.

22. Apparatus according to claim 17 wherein the control means comprises first and second position transducers operatively coupled to the first and second rotatable members, respectively, for monitoring relative tilt positions of the first and second members to therewith determine an instantaneous position of the pouring lip.

23. Apparatus according to claim 22 wherein the control means include compensation means for compensating a change in a relative vertical position of the pouring lip as a result of tilting of the container about the first axis.

24. Apparatus according to claim 21 including means for applying a vacuum to the housing, wherein the housing includes an opening, and wherein the first member comprises a plate overlying the opening and sealingly rotatably attached to the housing, and means operatively coupled with the housing and the plate for generating a force counteracting a force caused by vacuum in the housing urging the plate against the housing.

25. Apparatus according to claim 24 including a seal in an annular space between opposing surfaces of the plate and the housing defined by a floating seal ring arranged in the annular space concentrically with respect to the first axis.

26. Apparatus according to claim 25 wherein the floating seal includes first and second concentric, spaced-apart seal rings disposed in the space, and wherein the means for counteracting the force includes means for subjecting a portion of the space between the seal rings to a fluid medium pressurized to generate a force which substantially equals the force with which the plate is urged towards the housing.

27. Apparatus according to claim 21 wherein the first member comprises a plate and means mounting the plate to the housing for rotational movements about the first axis, and wherein the second member comprises support means carrying the container, extending from an interior of the housing to an exterior thereof through an opening in the plate, and bearing means mounting the support means to the plate for relative rotational movements of the support means about the second axis.

28. Apparatus according to claim 27 wherein the support means includes a tubular conduit extending from the interior of the housing to the exterior thereof, and including means extending through the tubular conduit for supplying electric power to the container for heating the container.

29. Apparatus according to claim 27 wherein the housing includes means defining a circular track which is concentric with the first axis, and including tracking means mounted to the plate and engaging the circular track for concentrically guiding the plate for rotational movements about the first axis.

30. Apparatus according to claim 26 wherein the plate includes means defining a circular track which is concentric with the first axis, and including tracking means mounted on the housing and engaging the circular track for concentrically guiding the plate for rotational movements about the first axis.

31. Apparatus for pouring a melt into a target opening comprising a container adapted to be filled with the melt to a liquid melt level and having a pouring lip proximate an upper end of the container; a holding device mounting the container so that the pouring lip can be located generally above the target opening; a tilting mechanism coupled to the holding device permitting tilting movements of the holding device and the container about first and second, spaced-apart, parallel, substantially horizontal axes, a spacing between the liquid level and the first axis being substantially larger than a spacing between the liquid level and the second axis so that the pouring lip can be moved over a substantial horizontal distance about the first axis without substantially moving the lip in a vertical direction relative to the target opening and about the second axis over a substantial vertical distance for initiating pouring the melt over the pouring lip into the target opening.

* * * * *